US007051906B2

(12) United States Patent
Kis et al.

(10) Patent No.: US 7,051,906 B2
(45) Date of Patent: May 30, 2006

(54) PACKAGE FOR A PHARMACEUTICAL PRODUCT AND METHOD OF STERILIZING THE PACKAGE

(75) Inventors: Gyorgy Lajos Kis, Triboltingen (CH); Eckhard Krautler, Dinhard (CH)

(73) Assignee: Novartis AG, Basel (CH)

( * ) Notice: Subject to any disclaimer, the term of this patent is extended or adjusted under 35 U.S.C. 154(b) by 0 days.

(21) Appl. No.: 09/973,256

(22) Filed: Oct. 9, 2001

(65) Prior Publication Data

US 2002/0020713 A1 Feb. 21, 2002

Related U.S. Application Data

(63) Continuation-in-part of application No. PCT/EP00/04828, filed on May 26, 2000.

(30) Foreign Application Priority Data

May 28, 1999 (EP) ..... 99110355

(51) Int. Cl.
*B65D 25/40* (2006.01)

(52) U.S. Cl. ..... 222/568; 222/562; 53/425

(58) Field of Classification Search ..... 222/568, 222/562; 53/425
See application file for complete search history.

(56) References Cited

U.S. PATENT DOCUMENTS 2,731,053 A * 1/1956 Lockhart ..... 150/0.5
3,709,365 A * 1/1973 Czaplinski et al. ..... 210/233
3,826,059 A * 7/1974 Novitch ..... 53/426
3,993,223 A * 11/1976 Welker, III et al. ..... 222/107
4,022,206 A * 5/1977 Hillerman et al. ..... 128/216
4,088,166 A * 5/1978 Miller ..... 604/408
4,150,744 A 4/1979 Fennimore ..... 206/205
4,178,976 A * 12/1979 Weiler et al. ..... 150/0.5
4,644,966 A * 2/1987 Ferrari ..... 132/73
4,718,463 A * 1/1988 Jurgens et al. ..... 141/11
4,805,377 A 2/1989 Carter ..... 53/415
4,834,256 A * 5/1989 McMillin ..... 220/66
5,033,252 A * 7/1991 Carter ..... 53/425
5,048,727 A * 9/1991 Vlasich ..... 222/209
5,052,558 A * 10/1991 Carter ..... 206/439
5,247,015 A * 9/1993 Bayan ..... 525/99
5,256,154 A * 10/1993 Liebert et al. ..... 604/199
5,316,054 A * 5/1994 Hall et al. ..... 141/22
5,373,684 A * 12/1994 Vacca ..... 53/425
5,380,295 A * 1/1995 Vacca ..... 604/187

(Continued)

FOREIGN PATENT DOCUMENTS

EP 0 322 134 6/1989

(Continued)

OTHER PUBLICATIONS

Kudernatsch et al., Pharm. Ind., vol. 61(7), "Rückblick auf die Interpack '99; Teil 1: Packmittel, Bedruckung, Etikettierung, Thermoform- und Kartoniermaschinen," pp. 643-652 (1999).

(Continued)

*Primary Examiner*—Frederick C. Nicolas
(74) *Attorney, Agent, or Firm*—Susan L. Hess

(57) ABSTRACT

The invention provides a pharmaceutical package including a polypropylene bottle in which is disposed a solution containing a pharmaceutical product, where the solution does not fill the bottle completely and some air is disposed in the bottle, and where the package, after autoclaving at at least 121C and for at least 20 minutes, suffers no deformation, does not shrink, and does not explode, and where the package retains a sufficiently high squeezability to dispense the solution.

9 Claims, 6 Drawing Sheets

U.S. PATENT DOCUMENTS

Figure 1:
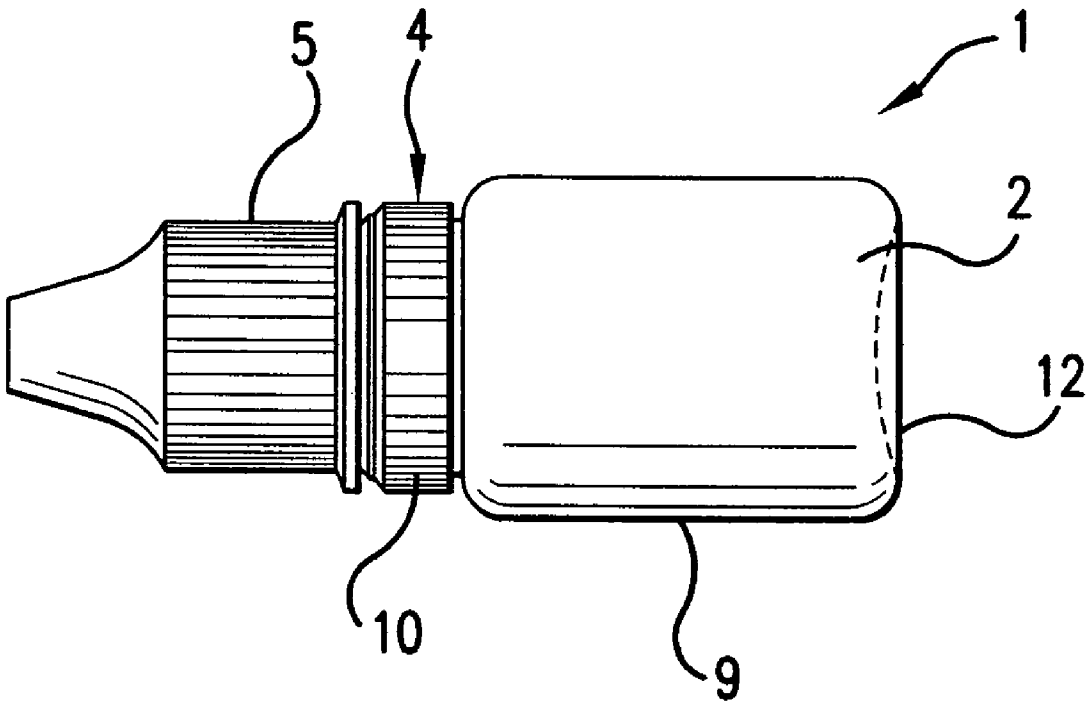

| | | | | | |
|---|---|---|---|---|---|
| 5,464,111 | A | * | 11/1995 | Vacek et al. | 215/249 |
| 5,472,431 | A | * | 12/1995 | Godat et al. | 604/199 |
| 5,733,617 | A | * | 3/1998 | Baduel | 428/36.8 |
| 5,842,326 | A | * | 12/1998 | Wolf | 53/425 |
| 5,975,381 | A | * | 11/1999 | Revenu | 222/563 |
| 6,129,925 | A | * | 10/2000 | Kido et al. | 424/400 |
| 6,227,413 | B1 | * | 5/2001 | Bommer | 222/190 |
| 6,382,438 | B1 | * | 5/2002 | Schneider et al. | 215/48 |

FOREIGN PATENT DOCUMENTS

| | | |
|---|---|---|
| GB | 1 544 260 | 4/1979 |
| WO | WO 95/08317 | 3/1995 |

OTHER PUBLICATIONS

International Search Report.

* cited by examiner

PACKAGE FOR A PHARMACEUTICAL PRODUCT AND METHOD OF STERILIZING THE PACKAGE

The invention relates to a package for a pharmaceutical product, particularly a tube or a dropper bottle assembly used to dispense liquids, aerosols or strings, and a method of sterilizing said package.

Particularly dropper bottle assemblies are used to dispense a variety of liquids, typically one drop at a time. For example, the dispensing of a liquid reagent used in laboratories, dispensing eye medication, dispensing ear medication, dispensing nose medication, or in any other environment where dispensing of a liquid in controlled drop increments is desired.

A typical prior art bottle assembly comprises a plastic squeeze bottle, a nozzle tip or dropper which is snap fit into the bottle and a cap or closure which is threaded onto the bottle. Liquid is dispensed one drop at a time by squeezing the bottle so as to force liquid out the end of the nozzle tip. The bottle, the nozzle tip and the cap are made of low density polyethylene because this material has a high enough modulus of elasticity for squeezing the cylindrical sidewall of the bottle with one's fingers which causes the liquid therein to pass through a passageway.

For filling the bottle with a pharmaceutical product, particularly an ophthalmic liquid which has to fulfill the conditions concerning sterility, it is state of the art to filtrate and to sterilize the solution or liquid which should be filled into the bottles by filtration or autoclaving. Also the bottles, the nozzle tips and the caps are sterilized, e.g. by ethylene oxide treatment, UV, gamma or electron beam irradiation. The filling of the bottles takes place in aseptic room conditions. However, after filling the bottles, inserting the nozzle tip into the neck portion and threading the cap onto the bottle no further sterilization will proceed. The filled and closed bottles are removed from the aseptic area. The aseptic area is normally a room which stands under slight excess air pressure and the entrance and the exit of the room are constructed as sluices.

A pharmaceutical product as used hereinbefore or hereinafter is understood to relate in particular to a pharmaceutical composition, which is preferably an aqueous and/or a non-aqueous pharmaceutical composition or a mixture of a non-aqueous and an aqueous pharmaceutical composition, which is preferably a liquid solution, a gel or an ointment, wherein pharmaceutical relates preferably to an ophthalmic, an otic and/or a nasal administration.

However, the standard method of filling bottles with pharmaceutical substances, particularly with ophthalmic solutions and gels does not fulfill the European Pharmacopoeia, 3rd. edition (1997) e.g. page 283, and/or the EU regulation (Committee of Proprietory Medicinal Products [CPMP], Section 5, Manufacturing Process, Note for Guidance). According to this regulation, an ophthalmic pharmaceutical liquid or gel should be terminally sterilized in their final container for achieving the highest level of sterility assurance, if ever possible. But using for sterilization an autoclaving method with a temperature of at least 121° C. for at least 15 minutes for the low density polyethylene bottles known in the prior art deformation, e.g. shrinkage or blowing up occur and the bottles have lost their elasticity so that they are damaged or partly molten and not squeezable anymore.

The invention addresses the problem of providing a pharmaceutical package, particularly a bottle assembly or a tube filled with a pharmaceutical product, particularly an ophthalmic solution or gel, meets the requirements of the European Pharmacopoeia regulation and/or EU-regulation without any significant deformation and retaining a sufficient squeezibility for dispensing the liquid after the autoclaving proceedings.

The invention solves this problem with the features indicated in both claims 1 and 10. With regard to further substantial design features, reference is made to the dependent claims.

The use of a specific form of polypropylene for the material of the package enables to fulfill the European Pharmacopoeia regulation and/or EU regulation. Packages made of a specific form of polypropylene are heat-resistant and retain their formation and their squeezing characteristics after the autoclaving processing. Therefore, the consumer can easily dispense one drop at a time by squeezing the package so as to force the pharmaceutical product out of the package. Particularly the invention provides a tube or a dropper bottle assembly with a high enough squeezibility for dispensing an ophthalmic solution or gel by compressing the tube or bottle.

Figure 2:
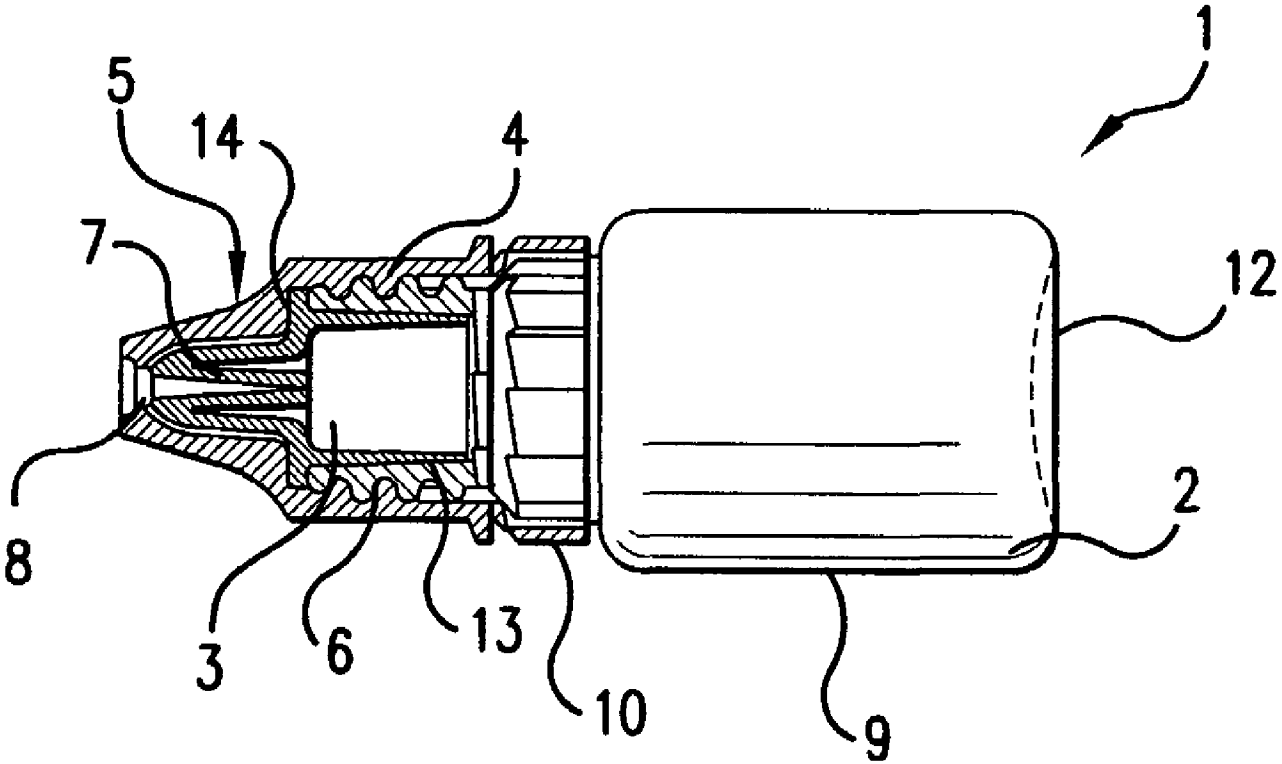
Figure 3:
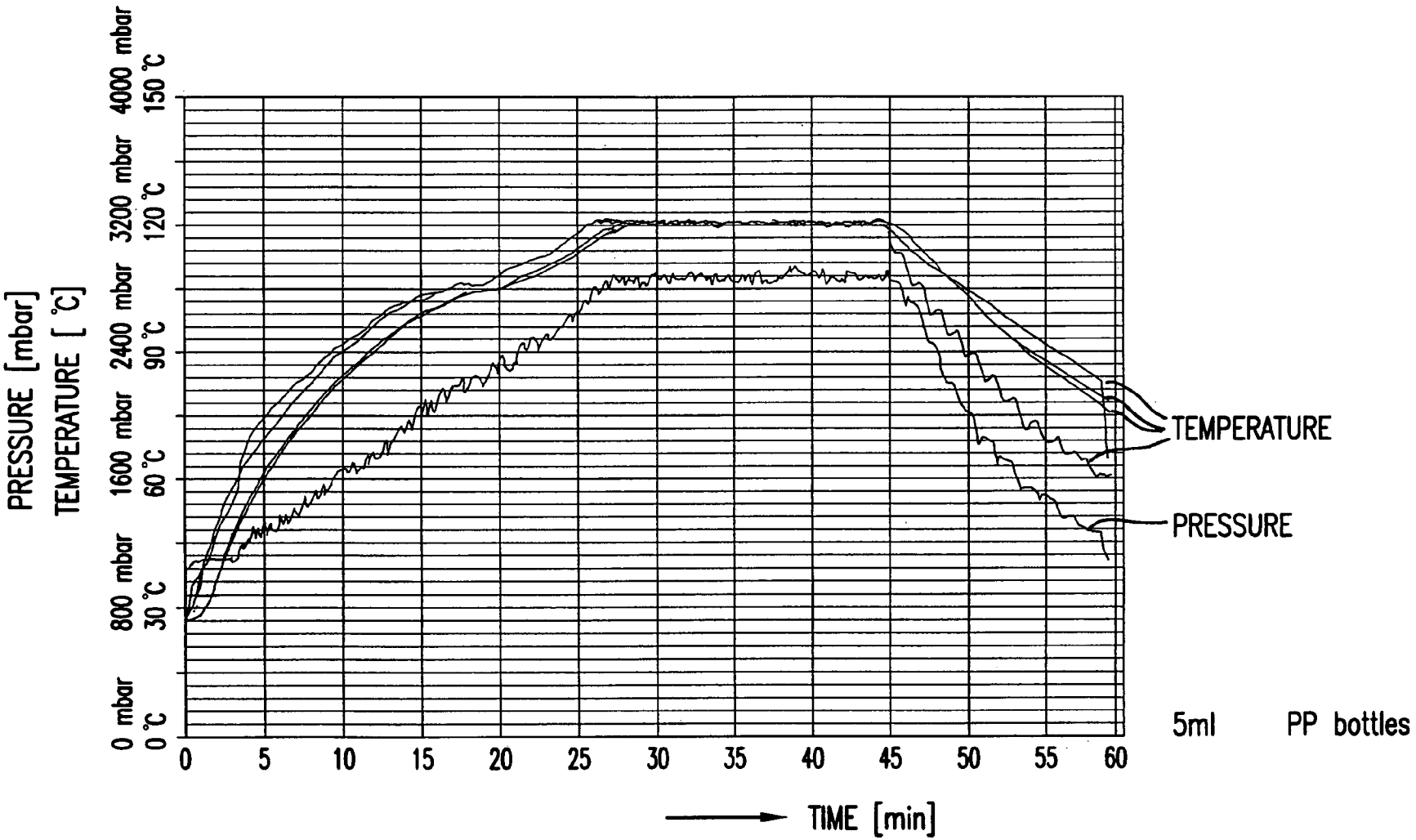
Figure 4:
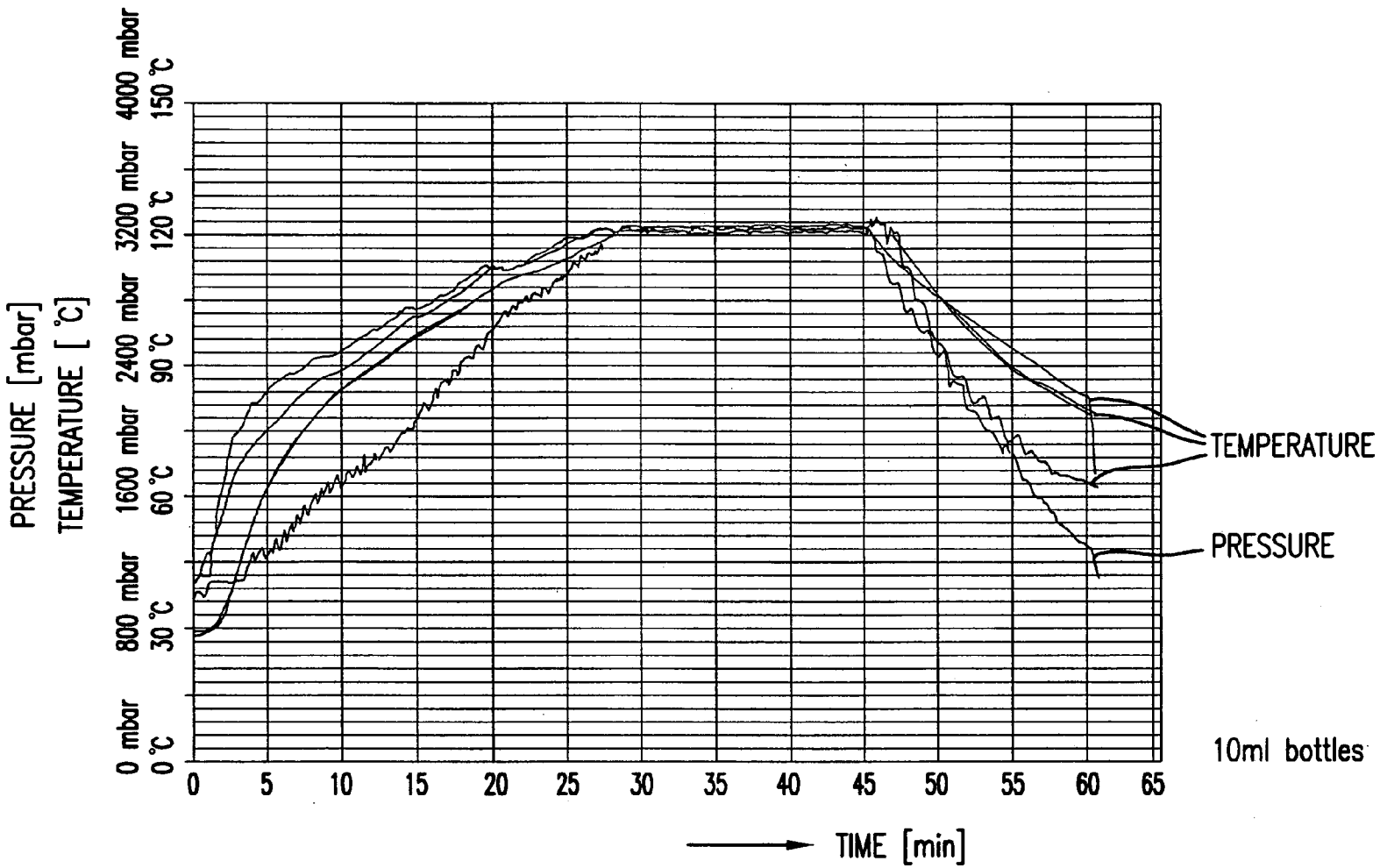
Figure 5:
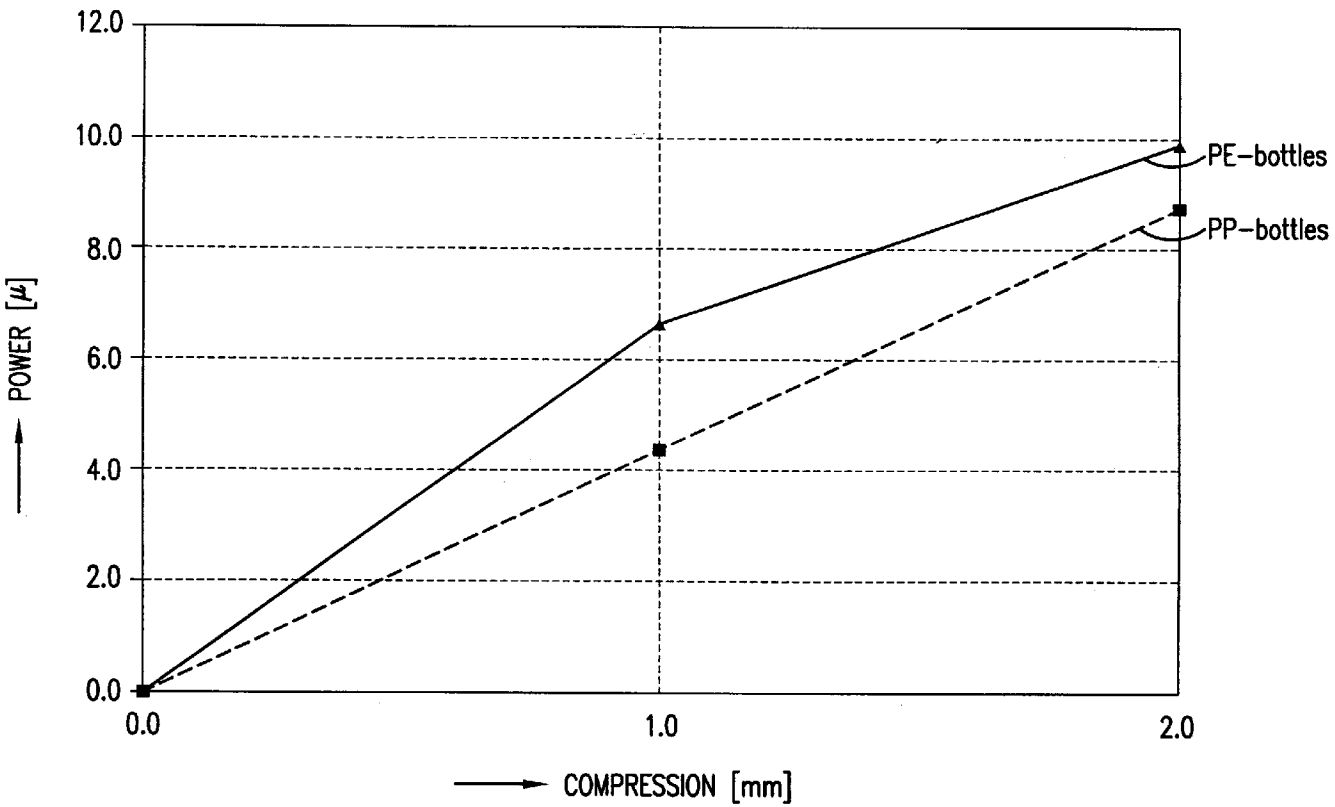
Figure 6:
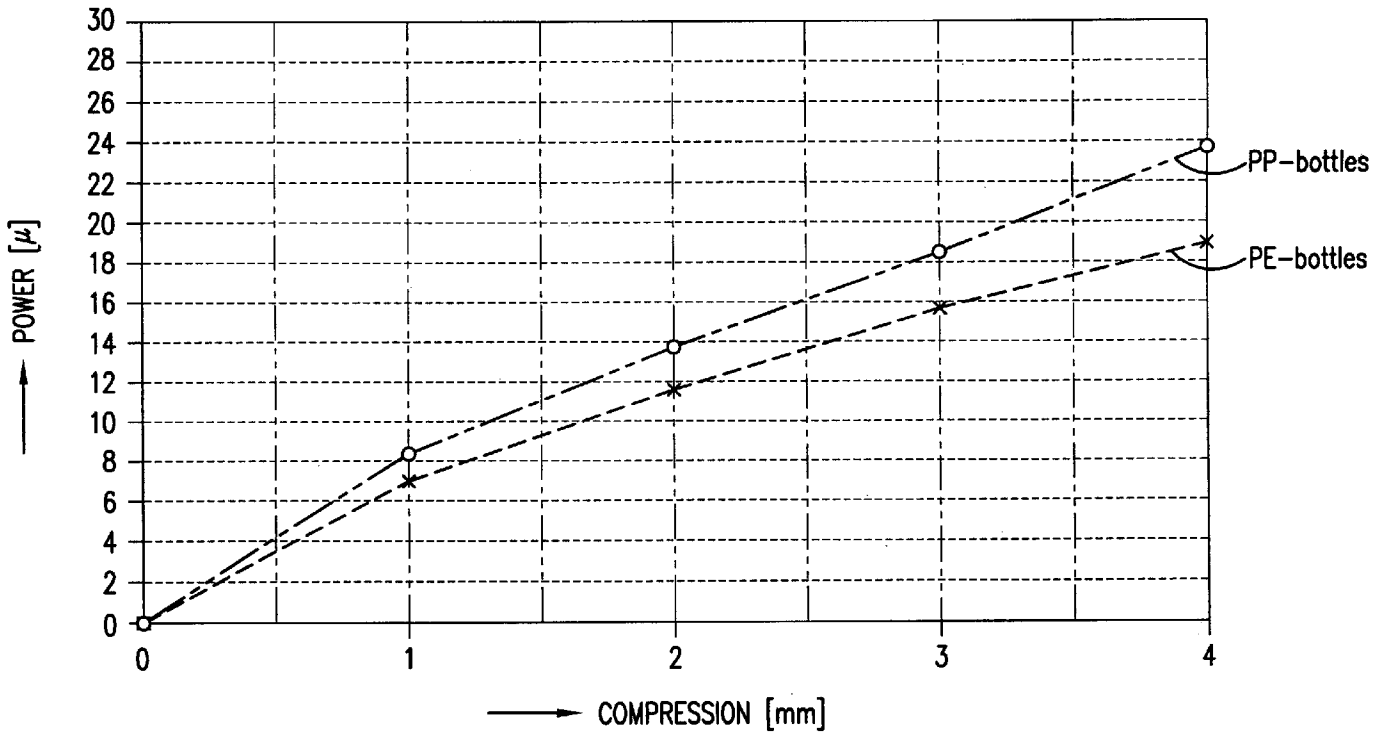

Further details and advantages of the invention are apparent from the following description and drawings. The drawings show:

FIG. 1 a front view of a dropper bottle assembly as an example of the invention;

FIG. 2 a front view, partially in cross section of a dropper bottle assembly in FIG. 1;

FIG. 3 a diagram of the temperature and the pressure run in the autoclaving chamber during the autoclaving processing for a 5 ml bottle;

FIG. 4 a diagram of the temperature and the pressure run in the autoclaving chamber during the autoclaving processing for a 10 ml bottle;

FIG. 5 a test diagram which shows the power as a function of the elasticity for a 5 ml bottle;

FIG. 6 a test diagram which shows the power as a function of the elasticity for a 10 ml bottle.

Referring to FIG. 1 and FIG. 2, there is illustrated as an example of the invention a dropper bottle assembly 1 which comprises a squeeze bottle 2 having a nozzle tip 3 designed to snap fit within the neck portion 4 of the bottle 2, and a cap 5 designed to fit over the nozzle tip 3 and engage threaded portion 6 of the neck portion 4. The nozzle tip 3 has a passageway 7 for allowing fluid within the bottle 2 to be dispensed through outlet 8. Liquid is dispensed by first removing cap 5 and then squeezing the cylindrical sidewall 9 of bottle 2 with one's fingers which causes the liquid therein to pass through a passageway 7. For safety purposes the bottle assembly is further provided with either a shrink collar or with a temper resistance ring 10.

The bottle 2 is made of a specific form of polypropylene, particularly a polypropylene of the type Appryl 3020 SM 3. In comparison with the prior art the bottle 2 has a similar shape with the exception that the bottom 12 has advantageously a concave configuration. This is in particular for avoiding deformation, e.g. shrinkage or blowing-up, of the bottle during the autoclaving processing. Due to the concave configuration the degree of pressure necessary to cause deformation of the bottom is much higher. Naturally, other indentation, grooves, slits or slots can be designed at the bottom 12 or the sidewall 9 to give the bottle 2 a greater stability during the autoclaving processing. The nozzle tip 3 is also particularly formed of a specific form of polypropylene, particularly a polypropylene of the type Appryl 3020 SM 3. There occur no problems during the autoclaving processing which could generate leakage problems. Rather, by using the same material for the bottle 3 and the nozzle tip 3 the two components are sealed a little bit together during the autoclaving processing. Furthermore, as polypropylene is a quite rigid material and it is more difficult to snap fit the nozzle tip 3 into the neck portion 4 of the bottle 2, the nozzle tip 3 has a special configuration to ensure a good seal between the bottle 2 and the nozzle tip 3. The sealing part 13 of the nozzle tip 3 used for sticking the nozzle tip 3 into the neck portion 4 of the bottle 2 is formed in the upper part nearly cylindrical whereas the lower part has the form of a taper shank. As a stopping face the sealing part 13 of the nozzle tip 3 is provided with a collar 14. The cap 5 is threaded on the neck portion 4 of the bottle 2 having external threads 6. The cap 5 as the closure of the bottle assembly is particularly formed of a high density polyethylene, particularly of HDPE GC 7260.The cap 5 can also be made of polypropylene, however in this case during the autoclaving processing a sealing between the nozzle tip 3 and the cap 5 can occur, so that it is quite difficult to open the bottle 2 or the nozzle tip 3 is damaged after opening of the bottle 2. If the cap 5 is made of another material than polypropylene, particularly of high density polyethylene, the risk of a sealing or other damages can be avoided as these two materials have a different modulus of elasticity.

The wall thickness of the PP bottle is typically in the range of 0.3 mm to 0.6 mm, preferably 0.45 mm. If the wall thickness is too thin, then the stability of the bottle decreases. However, if the wall thickness is too thick, then the squeezability of the bottle decreases and the bottle becomes too rigid. Indeed, the preferable value of the wall thickness is lower than in comparison with the prior art PE bottles, so that there is much lesser material necessary for molding the bottles, preferably by an injection molding process.

When the package of the present invention relates to a tube, the material may also be a so-called laminated PP-foil (polyfoil tube) exhibiting a sandwich-type structure. Typically such a laminated foil contain one or more layers of polypropylene (PP), preferably two (e.g. a top and a bottom layer), and one or more layers of aluminum, preferably one (e.g. the middle layer). Said laminated material provides typically enhanced stability.

Further, it is advantageous to adjust the autoclaving processing to the PP-bottles to avoid damages as shrinkage or blowing-up. After filling the bottles with the pharmaceutical liquid or gel, particularly an ophthalmic liquid or gel, the closed bottles are introduced into an autoclaving chamber. In the context of the present application filling of the bottles denotes typically a normal filling, such that for example in the upper part of said bottle some air will remain. As the whole bottles will be sterilized it is not anymore necessary that the filling and closing of the bottles has to take place under aseptic conditions. As it is known in the prior art, such an autoclaving chamber works with steam. The temperature and the pressure run in the chamber as a function of time is demonstrated in FIGS. 3 and 4. The chamber contains typically one or more nozzles for the steam entrance and typically several sensors for temperature monitoring. Advantageously the temperature can be adjusted very quickly if some corrections might be necessary.

Further, particularly the chamber is provided with a pressure device for generating a counter pressure in the autoclaving chamber. Also the pressure can be adjusted very quickly if some corrections might be necessary. Preferably, the counter pressure is regulated electronically via computer control. Said pressure set-up is advantageously used for avoiding a blowing-up of the bottles. After introducing the bottles into the chamber, the temperature rises typically from room temperature to 121° C. and the pressure rises typically from atmospheric pressure to a maximum value which is characteristic for the sterilization process. Typically, the choice of the pressure value depends on the form of the bottles.

FIG. 4 shows in an exemplary fashion the adjusted pressure with a value of 2700 mbar is lower for the 5 ml bottles than for the 10 ml bottles with a value of 3200 mbar. As the 5 ml bottles are more rigid in comparison to the 10 ml bottles a lower pressure value is necessary to avoid blowing up of the bottles. In the beginning of the autoclaving process the increasing of the temperature is quite steep, whereas the gradient of the pressure remains nearly constant up to reaching the maximum value. During the sterilization the values of the temperature and the pressure maintain constant. After the sterilization both the temperature and the pressure decreases continuously. The autoclaving processing takes as a whole nearly one hour. After reaching again room temperature and atmospheric pressure the chamber will be opened for taking out the sterilized bottles.

Several test programs have shown that after an autoclaving procedure of a temperature of 121° C. during 20 minutes with an autoclaving procedure according to the above described diagrams no deformation, e.g. shrinkage or blowing-up of the PP bottle assembly could be observed. Two diagrams demonstrating the squeezability of a bottle assembly with a volume of 5 ml and of 10 ml are shown in FIG. 5 and FIG. 6. To achieve typically a compression of 2 mm in comparison to the normal dimension of the bottle, typically a power value of about 9 N is necessary for a 5 ml PP-bottle. For a 10 ml PP bottle, typically a power value of about 14 N is required. For comparative purposes it should be mentioned that prior art PE bottles exhibit typically a similar squeezability, e.g. the 5 ml PE bottle slightly less, the 10 ml PE-bottles a little bit more power. For the consumer these values are virtually equivalent.

Further tests concerning the tightness of the bottles before and after the autoclaving procedure show compliance with the regulations for pharmaceuticals. Tests concerning the $O_2$-barrier and the $H_2O$-barrier properties of the bottles in accordance to the invention (despite of thinner walls) after stress storage during 4 weeks at 80° C. show no difference to the PE-bottles known from the prior art. Furthermore, tests in respect to bacteria toxicity show that no toxicity could be demonstrated for the PP-bottles. PE-bottles known from the prior art are typically twice as thick as the PP-package (PP-bottles) of the present invention.

Therefore, the invention provides a package particularly a tube or a dropper bottle assembly for pharmaceutical products, especially for ophthalmic pharmaceutical solutions and gels which can be sterilized as a whole after filling the product into the package by an autoclaving process in accordance to the invention. The package retains after the autoclaving procedure its squeezability which is important for the consumer for dispensing especially a solution or gel out of the package. Furthermore, no deformation could be observed after having exposed said package to an autoclaving process in accordance to the invention. This means that a package according to the invention, especially a dropper bottle assembly filled with an ophthalmic solution, gel or ointment, fulfills the European Pharmacopoeia, 3rd. edition (1997), and/or the EU regulation mentioned above, which ensure a higher level of safety.

In addition, the PP-material used for fabricating the package in accordance to the invention exhibits physical chemical properties which meet the requirements laid down in the supplement of 1998 of the European Pharmacopoeia, 3rd edition (1997). This is in particular applicable to the additives comprised in the PP-material in accordance to the invention.

The invention claimed is:

1. A pharmaceutical package comprising a closed polypropylene bottle in which is disposed a solution or gel, the solution or gel comprising a pharmaceutical product, wherein the solution or gel does not fill the bottle completely and some air is disposed in the bottle, and wherein the package is autoclaved by:

a) placing the closed package into an autoclaving chamber;

b) adjusting the temperature and the pressure in the chamber as a function of time in accordance to the prerequisites of the material of the package, wherein a counter pressure is generated in the chamber and wherein the counter pressure is regulated electronically by computer control; and wherein the package, after autoclaving at at least 121° C. and for at least 20 minutes, suffers no deformation, does not shrink, and does not explode, and where the package retains a sufficiently high squeezability to dispense one drop at a time the solution or gel.

2. A package according to claim 1, wherein said package further comprises a plastic nozzle tip for dispensing the solution or gel and a cap for closing said bottle, wherein said bottle has walls that have a wall-thickness.

3. A package according to claim 2, wherein said bottle comprises a neck portion that includes an externally threaded portion and an outer rim which defines an outlet of the bottle, wherein said nozzle tip is in fluid contact with said outlet of said bottle and wherein said nozzle tip has a dispensing pathway in fluid communication with an outlet, and wherein said cap has internal threads for engagement with said externally threaded portion of said neck portion of said bottle.

4. A package according to claim 3, wherein said bottle is made of Appryl 3020 SM 3, the nozzle tip is made of Appryl 3020 SM 3, and the cap is made of HDPE GC 7260 or of low density polyethylene.

5. A package according to claim 4, wherein said bottle has a bottom portion, and said bottom portion of said bottle has a concave configuration.

6. A package according to claim 5, wherein said bottle has a wall-thickness in the range of 0.3 mm to 0.6 mm.

7. A package according to claim 6, wherein said wall-thickness is 0.45 mm.

8. A package of claim 1, wherein physical chemical properties of said polypropylene meet requirements laid down in the supplement of 1998 of the European Pharmacopoeia, $3^{rd}$ edition (1997).

9. A package of claim 7, wherein physical chemical properties of said polypropylene meet requirements laid down in the supplement of 1998 of the European Pharmacopoeia, $3^{rd}$ edition (1997).

* * * * *